US006031215A

United States Patent [19]

Nanataki et al.

[11] Patent Number: 6,031,215

[45] Date of Patent: Feb. 29, 2000

[54] IMAGE HEATING DEVICE USING INDUCTION HEATING FOR IMAGE HEATING

[75] Inventors: Hideo Nanataki, Tokyo; Koichi Tanigawa, Mishima; Atsuyoshi Abe, Susono; Tetsuya Sano, Numazu, all of Japan

[73] Assignee: Canon Kabushiki Kaisha, Tokyo, Japan

[21] Appl. No.: 08/824,455

[22] Filed: Mar. 26, 1997

[30] Foreign Application Priority Data

Mar. 29, 1996 [JP] Japan ..... 8-103371
Jan. 30, 1997 [JP] Japan ..... 9-016485

[51] Int. Cl.[7] ..... H05B 6/14; G03G 15/20

[52] U.S. Cl. ..... 219/619; 219/634; 399/330; 399/332; 399/336

[58] Field of Search ..... 219/619, 634, 219/653, 659, 647, 649, 469; 399/328, 329, 330, 331, 332, 333, 334, 335, 336

[56] References Cited

U.S. PATENT DOCUMENTS 4,570,044 2/1986 Kobayashi et al. .
4,912,514 3/1990 Mizutani .
4,948,466 8/1990 Jaakkola ..... 219/619
5,153,654 10/1992 Yuminamochi et al. .
5,177,549 1/1993 Ohtsuka et al. .
5,278,618 1/1994 Mitani et al. .
5,331,385 7/1994 Ohtsuka et al. .
5,420,679 5/1995 Goto et al. .
5,438,398 8/1995 Tanigawa et al. .
5,552,582 9/1996 Abe et al. .
5,568,240 10/1996 Ohtsuka .
5,713,069 1/1998 Kato ..... 399/30
5,745,833 4/1998 Abe et al. ..... 399/330

FOREIGN PATENT DOCUMENTS 51-109737 9/1976 Japan .
62-150371 7/1987 Japan .
54-9027 1/1993 Japan .

OTHER PUBLICATIONS

U.S. application No. 08/600,518, Atsuuyoshi Abe, et al., filed Feb. 13, 1996.
U.S. application No. 08/678,980, Hideo Nanataki, et al., filed Jul. 12, 1996.

*Primary Examiner*—Philip H. Leung
*Attorney, Agent, or Firm*—Fitzpatrick, Cella, Harper & Scinto

[57] ABSTRACT

In an image heating device for heating a film utilizing electromagnetic induction, a sliding member is provided between the film and a film supporting member, and the film slides relative to the sliding member. It is thereby possible to improve thermal efficiency while preventing wear due to friction between the film and the supporting member.

23 Claims, 15 Drawing Sheets

IMAGE HEATING DEVICE USING INDUCTION HEATING FOR IMAGE HEATING

BACKGROUND OF THE INVENTION

1. Field of the Invention

This invention relates to an image heating device applied to a copier, a printer or the like, and more particularly, to a device for heating a film utilizing electromagnetic induction.

2. Description of the Related Art

Japanese Utiliy Model Laid-Open Application (Kokai) No. 51-109737 (1976) discloses an induction-heating fixing device for heating a fixing roller utilizing Joule heat by inducing a current therein by a magnetic flux. Since the fixing roller can be directly heated by utilizing the generation of an induced current, a fixing processing having higher efficiency than a heating roller using a tungsten halogen lamp is achieved.

In the electromagnetic-induction heating device disclosed in Japanese Utility Model Laid-Open Application (Kokai) No. 51-109737 (1976), since the energy of an AC magnetic flux generated by an exciting coil is used for raising the temperature of the entire fixing roller, radiation loss is large and the ratio of the fixing energy to the input energy is low, thereby causing an inferior efficiency.

In order to overcome the above-described problems in such an electromagnetic-induction heating device, a method for obtaining high-density thermal energy for fixing by disposing an induction heating unit in the vicinity of a fixing nip portion and using a low-heat-capacity resistor (an electromagnetic-induction heating member made of a magnetic conductive material) having the shape of a cylindrical film, such as a nickel electrodeposited film, as a heater.

In this fixing device, however, the following new problems also arise. That is, when using the above-described cylindrical film as the heater, a supporting member for supporting the cylindrical film from the inside is required in order to provide a sufficient strength to resist a pressing force necessary for fixing. Since the inner surface of the cylindrical film rubs the supporting member, the driving torque increases, and wear or degradation tends to occur.

If the metallic layer made of nickel or the like is present on the inner surface of the cylindrical film, the metallic layer rubs the supporting member, thereby facilitating the occurrence of wear.

In order to overcome such problems, a resin layer may be provided on the inner surface of the cylindrical film for the purpose of increasing wear resistance. In general, a releasing layer made of a fluororesin or the like is formed on the surface of the cylindrical film in order to prevent offset at fixing. Hence, uniform cylindrical resin layers must be provided in a state of facing both surfaces of the resistor layer (metallic layer) serving as the heater. However, the provision of such cylindrical films causes an increase in the production cost and in the heat capacity, and therefore in the rise time. In addition, since the resin layer on the inner surface moves together with the resistor layer, the rate of contribution of thermal energy stored in the resin layer to the heating of an image is reduced, thereby degrading thermal efficiency.

SUMMARY OF THE INVENTION

It is an object of the present invention to provide an image heating device having excellent slidability between a film heated by electromagnetic induction and a supporting member without increasing the rise time of the device.

It is another object of the present invention to provide an image heating device having excellent slidability between a film heated by electromagnetic induction and a supporting member without degrading the efficiency of heat contributing to the heating of an image.

It is still another object of the present invention to provide an image heating device including a sliding member, provided between a film heated by electromagnetic induction and a supporting member, which slides relative to the film.

According to one aspect, the present invention which achieves these objectives relates to an image heating device including a film having a conductive portion, and a magnetic-flux generation unit for generating a magnetic flux. An eddy current is generated in the film by the magnetic flux generated by the magnetic-flux generation unit, the film is heated by the eddy current, and an image on a recording material is heated by the heat of the film. The device also includes a supporting member for supporting the film, and a sliding member provided between the film and the supporting member. The film slides relative to the sliding member.

According to another aspect, the present invention relates to an image heating device including conductive means, magnetic-flux generation means, supporting means and sliding means. The conductive means has a conductive portion for being heated. The magnetic-flux generation means generates a magnetic flux. An eddy current is generated in the conductive means by the magnetic flux generated by the magnetic-flux generation means and the conductive means is heated by the eddy current. The supporting means supports the conductive means. The sliding means facilitates sliding of the conductive means relative to the supporting means. The sliding means is provided between the conductive means and the supporting means.

According to yet another aspect, the present invention relates to an image forming device including image forming means and image heating means. The image forming means forms an image on a recording material. The image heating means heats the image formed on the recording material. The image heating means includes a film having a conductive portion, magnetic-flux generation means for generating a magnetic flux, a supporting member for supporting the film, and a sliding member provided between the film and the supporting member. An eddy current is generated on the film by the magnetic flux generated by the magnetic-flux generation means and the film is heated by the eddy current.

The foregoing and other objects, advantages and features of the present invention will become more apparent from the following detailed description of the preferred embodiments taken in conjunction with the accompanying drawings.

BRIEF DESCRIPTION OF THE DRAWINGS

FIG. 8(*b*) is a bottom view of the film guide shown in FIG. 8(*a*);

FIG. 15(*b*) is a bottom view of the film guide shown in FIG. 15(*a*);

DETAILED DESCRIPTION OF THE PREFERRED EMBODIMENTS

A description will now be provided of preferred embodiments of the present invention with reference to the drawings.

Figure 5:
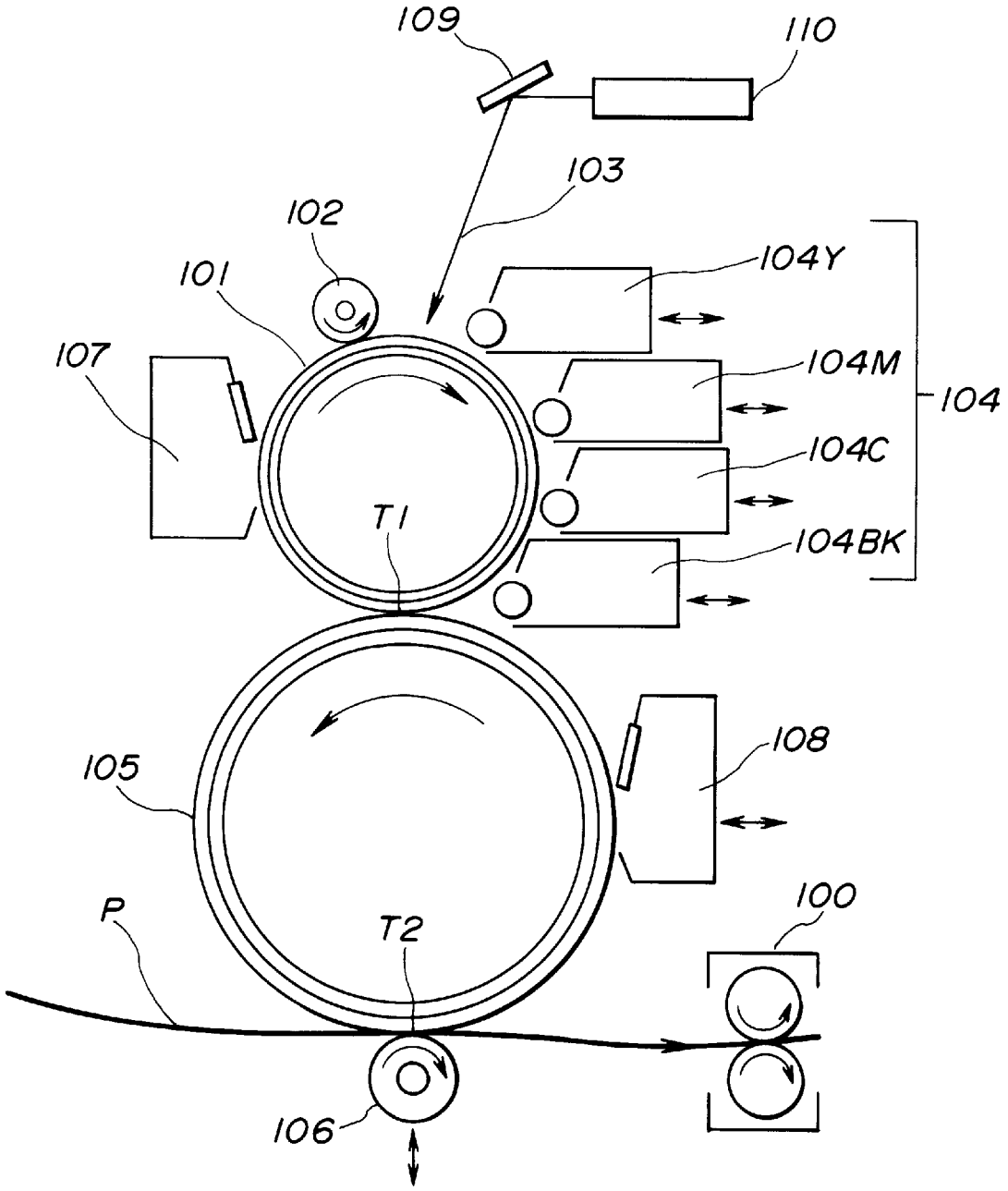
FIG. 5 is a schematic diagram illustrating the configuration of an image forming apparatus to which an image heating device of the invention can be applied.

FIG. 5 is a schematic diagram illustrating the configuration of an image forming apparatus including an image heating device (fixing device) according to an embodiment of the present invention. This image forming apparatus is an electrophotographic four-color printer.

First, the configuration and the operation of the image forming apparatus will be described.

In FIG. 5, an electrophotographic photosensitive drum (image bearing member) 101 made of an organic photoconductor or amorphous silicon is rotatably driven in the direction of the arrow at a predetermined process speed (circumferential speed).

While being rotated, the photosensitive drum 101 is uniformly charged by a charging device 102, such as a charging roller or the like, to a predetermined potential of a predetermined polarity.

Then, the charged surface of the photosensitive drum 101 is subjected to scanning exposure of target image information by laser light 103 output from a laser scanner 110. The laser scanner 110 performs scanning exposure of the surface of the rotating photosensitive drum 101 by outputting the laser light 103 modulated (turned on/off) in accordance with a time-serial electric digital pixel signal representing the target image information from an image-signal generation device (not shown), such as an image reading device or the like. An electrostatic latent image corresponding to the target image information is formed on the surface of the rotating photosensitive drum 101 by the scanning exposure. A mirror 109 deflects the laser light 103 output from the laser scanner 110 onto an exposure position on the photosensitive drum 101.

When forming a full-color image, a latent image corresponding to a first color-separation-component image, for example, a yellow-component image, of the full-color image is formed by scanning exposure, and is developed by a yellow developing unit 104Y of a four-color developing device 104 as a yellow toner image. The yellow toner image is transferred onto the surface of an intermediate transfer drum 105 at a primary transfer portion Ti, which is a contact portion (or proximity portion) between the photosensitive drum 101 and the intermediate transfer drum 105. The surface of the rotating photosensitive drum 101 after the transfer of the toner image to the surface of the intermediate transfer drum 105 is cleaned by a cleaner 107 which removes adhering residues, such as toner particles remaining after the image transfer, and the like.

The above-described process cycle, comprising charging, scanning exposure, development, primary transfer and cleaning, is sequentially performed for a second color-separation-component image (for example, a magenta-component image to be developed by a magenta developing unit 104M), a third color-separation-component image (for example, a cyan-component image to be developed by a cyan developing unit 104C) and a fourth color-separation-component image (for example, a black-component image to be developed by a black developing unit 104Bk). The obtained yellow, magenta, cyan and black toner images are sequentially transferred onto the surface of the intermediate transfer drum 105 in an overlapped state, so that a color toner image corresponding to the target full-color image is synthesized.

The intermediate transfer drum 105 comprises a medium-resistance elastic layer and a high-resistance surface layer formed on a metallic drum, and is rotatably driven in a counterclockwise direction indicated by the arrow at a circumferential speed which is substantially the same as that of the photosensitive drum 101 while contacting or approaching the photosensitive drum 101. By applying a bias potential to the metallic drum of the intermediate transfer drum 105, the toner image on the photosensitive drum 101 is transferred onto the surface of the intermediate transfer drum 105 by the potential difference between the intermediate transfer drum 105 and the photosensitive drum 101.

The color toner image synthesized on the surface of the rotating intermediate transfer drum 105 is then transferred at a secondary transfer portion T2, which is a contact nip portion between the rotating intermediate transfer drum 105 and a transfer roller 106, onto the surface of a recording material P fed from a sheet feeding unit (not shown) to the secondary transfer portion T2 at a predetermined timing. By supplying charges having a polarity opposite to that of the toner from the back of the recording material P, the transfer roller 106 transfers the synthesized color toner image from the surface of the intermediate transfer drum 105 onto the recording material P.

The recording material P passing through the secondary transfer portion T2 is separated from the surface of the intermediate transfer drum 105 and is guided to an electromagnetic-induction-heating fixing device 100. The unfixed toner image on the recording material P is subjected to heating fixing processing, and the recording material P is then discharged onto a discharged-sheet tray (not shown) provided at the outside of the apparatus as a sheet having a color image.

The rotating intermediate transfer drum 105 after the transfer of the color toner image to the recording material P is cleaned by a cleaner 108, which removes adhering residues, such as remaining toner particles after the image transfer, the powder of paper, and the like. The cleaner 108 is usually held in a state of not contacting the intermediate transfer drum 105, and is brought in contact with the intermediate transfer drum 105 during the secondary transfer process of the color toner image from the intermediate transfer drum 105 to the recording material P.

The transfer roller 106 is also usually held in a state of not contacting the intermediate transfer drum 105, and is brought in contact with the intermediate transfer drum 105 via the recording material P during the secondary transfer process of the color toner image from the intermediate transfer drum 105 to the recording material P.

A mode of printing a monocolor image, such as a black-and-white image, a mode of printing a duplex image, or a mode of printing a multiplex image can also be executed.

In the duplex-image printing mode, a recording material P having a transferred toner image on its first surface leaving the fixing device 100 is again fed to the secondary transfer portion T2 in a state in which the surface of the recording material P is reversed by a recycling conveying mechanism (not shown). Another toner image is then transferred onto the second surface of the transfer material P at the secondary transfer portion T2. The recording material P is then fed to the fixing device 100, which fixes the toner image on the second surface of the recording material P. Thus, the recording material P having images on both surfaces thereof is obtained.

In the multiplex-image printing mode, a recording material P having a transferred toner image on its first surface leaving the fixing device 100 is again fed to the secondary transfer portion T2 in a state in which the surface of the recording material P is not reversed by the recycling conveying mechanism. Another toner image is then transferred onto the surface of the transfer material P having the first image at the secondary transfer portion T2. The recording material P is then fed to the fixing device 100, which fixes the second toner image on the surface of the recording material P. Thus, the recording material P having a multiplex image is obtained.

Next, a description will be provided of an image heating device according to an embodiment of the present invention.

Figure 1:
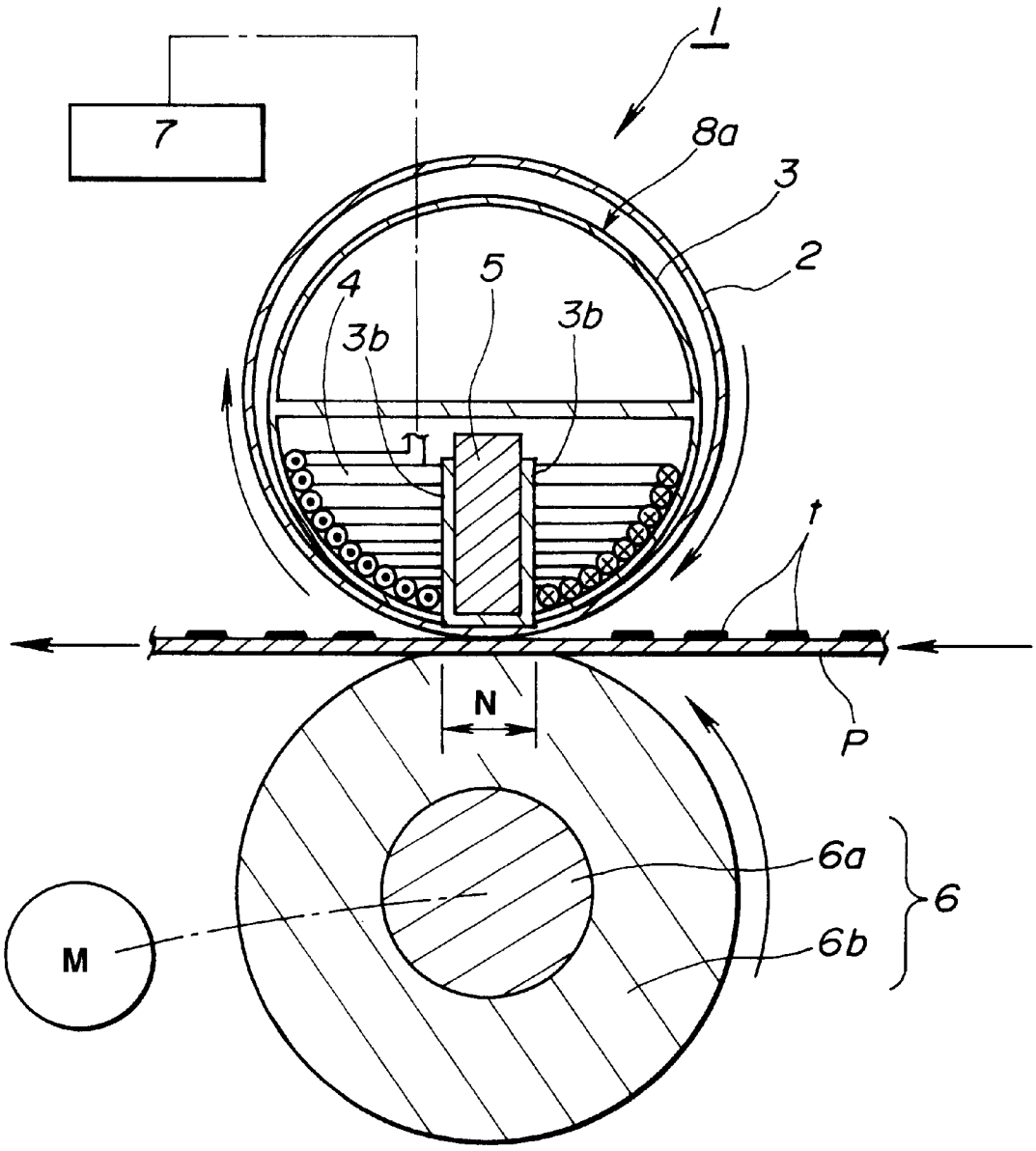
FIG. 1 is a schematic cross-sectional view illustrating the configuration of an image heating device according to an embodiment of the present invention.

FIG. 1 is a schematic cross-sectional view illustrating the configuration of the image heating fixing device, which is an electromagnetic-induction heating device, of the embodiment.

1) The schematic configuration and the fixing operation of the device

In FIG. 1, a fixing film assembly 1 includes a resistor 2 having the shape of a cylindrical film, serving as a rotating heating member (hereinafter termed a "fixing film"), a cylindrical film supporting member 3 for supporting the cylindrical fixing film 2 from the inside (hereinafter termed a "film guide"), an exciting coil 4, serving as magnetic-field generation means (magnetic-flux generation means), disposed inside the cylindrical film guide 3, for generating an AC magnetic flux, a core 5, and the like. The cylindrical fixing film 2 is loosely fitted to the outer circumference of the cylindrical film guide 3. The fixing film assembly 1 is disposed in a state in which the both ends of the film guide 3 are held between side plates of the device present at the front side and the rear side as seen from FIG. 1.

An elastic pressing roller 6, serving as a pressing rotating member (backup member), comprises a core 6*a,* and a silicone-rubber layer 6*b* 2mm thick concentrically integrated around the core 6*a*, and is pivotably held between the side plates of the device under the fixing film assembly 1 so as to be substantially parallel to the fixing film assembly 1. The elastic pressing roller 6 is in pressure contact with the lower surface of the film guide 3 of the fixing film assembly 1 via the fixing film 2 with a predetermined pressing force to form a fixing nip portion N having a predetermined width.

The pressing roller 6 is rotatably driven in a counterclockwise direction indicated by the arrow at a predetermined circumferential speed by a driving force transmitted from a driving source M via a drive transmission system (a pressing-roller driving method). In accordance with the rotation of the pressing roller 6, a rotation force is applied to the cylindrical fixing film 2, loosely fitted to the outer circumference of the film guide 3 of the fixing film assembly 1, at the fixing nip portion, which is the pressed portion between the fixing film assembly 1 and the pressing roller 6, due to the frictional force between the rotating pressing roller 6 and the outer circumference of the fixing film 2. The cylindrical fixing film 2 is thereby rotated in a clockwise direction indicated by the arrow at a circumferential speed substantially equal to the circumferential speed of the pressing roller 6 in a state in which the inner surface of the fixing film 2 slides in close contact with the lower surface of the film guide 3 at the fixing nip portion N.

An exciting circuit 7 supplies the exciting coil 4 with an AC current (80-kHz high-frequency current).

Figure 4:
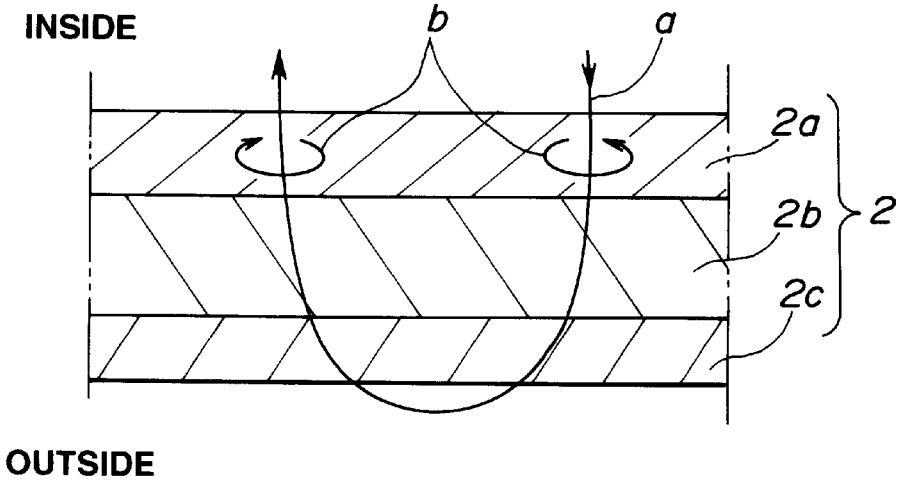
FIG. 4 is a schematic diagram illustrating the configuration of a film shown in FIG. 1.

The exciting coil 4 generates an AC magnetic flux by the AC current supplied from the exciting circuit 7. The AC magnetic flux concentrates in the vicinity of the fixing nip portion N due to the presence of the core 5 at the position of the fixing nip portion N. As shown in FIG. 4, the AC magnetic flux "a" generates eddy currents "b" in a resistor layer 2*a* (to be described later), serving as a heating layer, of the fixing film 2. The eddy currents "b" generate Joule heat in the resistor layer 2*a* due to the specific resistance of the resistor layer 2*a*. That is, the fixing film 2 is heated by electromagnetic induction. The electromagnetic induction heating of the fixing film 2 is concentrated in the vicinity of the fixing nip portion N where the AC magnetic flux is concentrated, so that the fixing nip portion N is very efficiently heated. The fixing nip portion N is controlled to a predetermined temperature by controlling current supply to the exciting coil 4 by a temperature control system including temperature detection means (not shown).

In the present embodiment, by disposing the exciting coil 4 so as to concentrate in the vicinity of the fixing nip portion N, it is possible to arrange the generated magnetic field to pass through a desired heating region of the resistor layer 2*a* of the fixing film 2, and therefore to realize a very efficient fixing device.

In a state in which the pressing roller 6 is rotatably driven, the cylindrical fixing film 2 is thereby rotated along the outer circumference of the film guide 3, and the temperature of the fixing nip portion N reaches a predetermined temperature by the electromagnetic induction heating of the fixing film 2 by current supply from the exciting circuit 7 to the exciting coil 4, a recording material P, having an unfixed toner image t on its surface, conveyed from the image forming means is guided between the fixing film 2 and the pressing roller 6 at the fixing nip portion N in a state in which the image surface is placed upward, i.e., it faces the surface of the fixing film 2. The recording material P is grasped and conveyed through the fixing nip portion N together with the fixing film 2 in a state in which the image surface is in close contact with the outer surface of the fixing film 2. During this process, the unfixed toner image t on the recording material P is heated and fixed by the electromagnetic induction of the fixing film 2. After passing through the fixing nip portion N, the recording material P is separated from the outer surface of the rotating fixing film 2, and is conveyed and discharged.

2) The film guide 3 and a sliding member 8*a*

The film guide 3 incorporates the exciting coil 4, serving as the magnetic-field generation means, and the core 5, and has the role of stabilizing the conveyability of the cylindrical fixing film 2, fitted to the outer circumference of the film guide 3, during rotation by holding it. The film guide 3 is made of an insulating material which does not hinder the passage of the magnetic flux, and is preferably resistant against high load, such as PPS, PEEK, a phenol resin or the like.

As described above, the inner surface of the fixing film 2 (the inner surface of the resistor layer 2*a*), serving as the rotating heating member, rubs the film guide 3, serving as the supporting member for the fixing film 2. Hence, the driving torque increases, and wear and degradation tend to occur.

Figure 2:
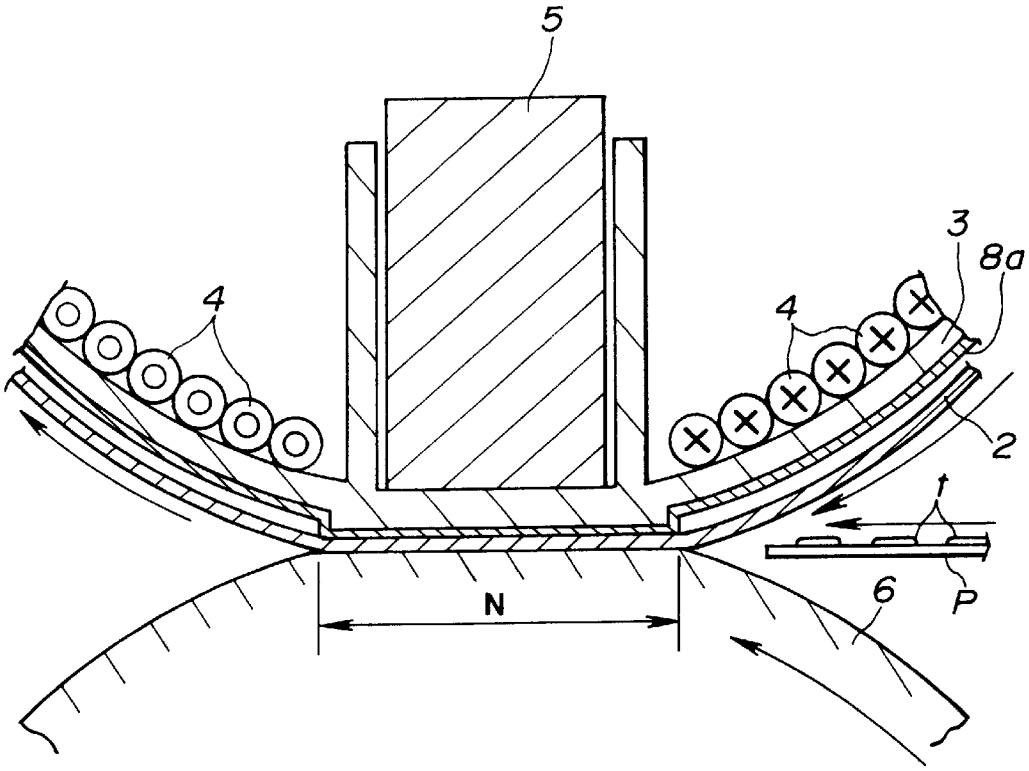
FIG. 2 is an enlarged view of a nip portion shown in FIG. 1.

Accordingly, in the present embodiment, as shown in the schematic partially enlarged view of FIG. 2, a sliding member (slidably contacting layer) 8*a* having a surface sliding relative to the inner surace, i.e., the resistor layer 2*a*, of the fixing film 2 is provided at the outer surface of the film guide 3, so that the cylindrical fixing film 2 is supported on the film guide 3 via the sliding member 8*a*. Thus, an increase in the driving torque, and the occurrence of wear and degradation due to the rub of the fixing film 2 with the film guide 3 are prevented. The sliding member 8*a* covers at least the fixing nip portion N.

A fluororesin, such as a PFA resin, a PTFE (polytetrafluroethylene) resin, a FEP resin or the like, a heat resistant resin, such as a polyimide resin, a polyamide resin, a polyamide-imide resin, a resin obtained by mixing these resins, or the like, is preferably used for the sliding member 8*a*. In the present embodiment, the sliding member 8*a* is formed by covering the entire outer circumferential surface of the film guide 3 with a heat-contractive tube 50 $\mu$m thick made of a PFA resin. The thickness of the sliding member 8*a* is preferably 10–1,000 $\mu$m. If the thickness of the sliding member 8*a* is less than 10 $\mu$m, a poor abrasion resistance is provided, and therefore durability is insufficient. On the other hand, if the thickness of the sliding member 8*a* exceeds 1,000 $\mu$m, the distance between the core 5 having a high permeability and the resistor layer 2*a* of the fixing film 2 increases, so that the magnetic flux does not sufficiently reach the resistor layer 2*a*.

It is not against the gist of the present invention to supply an appropriate amount of lubricant, such as grease or the like, between the sliding member 8*a* and the fixing film 2. The sliding member in the present invention is a substance having a large area in contact with the inner surface of the fixing film 2 within the fixing nip portion N. A lubricant does not satisfy this condition because it stays in a gap portion formed between the fixing film 2 and the film guide 3 due to its high fluidity. Accordingly, it operates only as auxiliary means for reducing the driving torque and improving durability which are targets in the present invention.

3) The exciting coil 4 and the core 5

Figure 3:
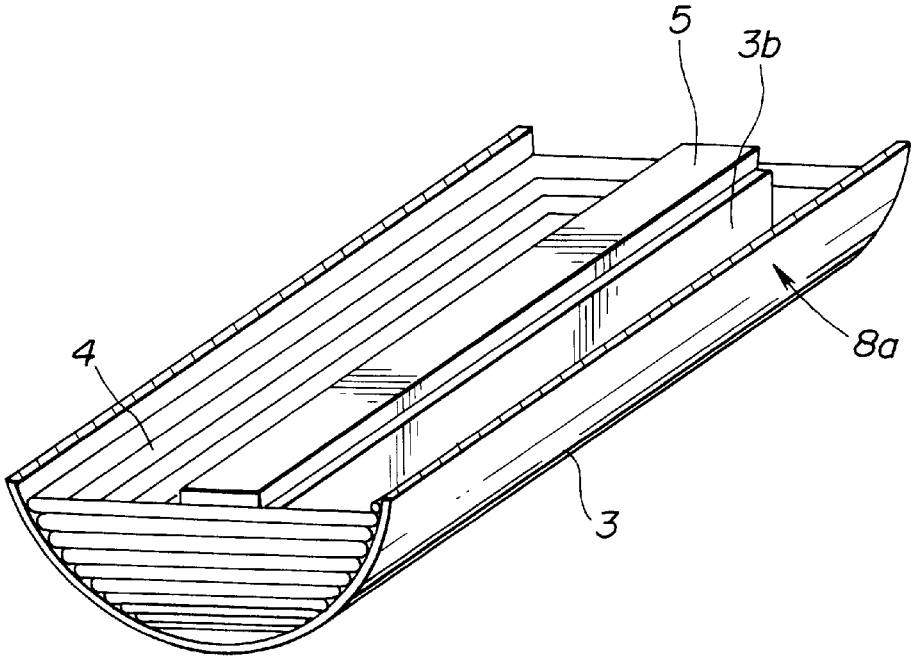
FIG. 3 is a cutaway perspective view of a film guide shown in FIG. 1.

FIG. 3 is a cutaway perspective view showing the lower half portion of the inside of the film guide 3. Two parallel rib plates 3*b*, 3*b* (see FIG. 1) are provided with an interval along the longitudinal direction of the film guide 3 at central portions of the inner base of the film guide 3, and the core 5 is inserted and held in a space between the rib plates 3*b*, 3*b*. The core 5 is a high-permeability member which is long in the longitudinal direction of the film guide 3, and is preferably made of a material used for the core of a transformer, such as ferrite, permalloy or the like. More preferably, ferrite having a low loss at frequencies of 20–100 kHz may be used.

In the present embodiment, the exciting coil 4 is configured by winding an electric wire in a boat form so as to substantially correspond to the lower half portion of the inner surface of the cylindrical film guide 3. The boat-formed exciting coil 4 is positioned and held on substantially the lower half portion of the inner surface of the cylindrical film guide 3. The core 5 is positioned at substantially the central portion within the boat-formed exciting coil 4.

The exciting coil 4 must generate an AC magnetic flux sufficient for heating. For that purpose, it is necessary to make the resistive component and the inductive component of the exciting coil 4 low and high, respectively. In the present embodiment, five turns of a core wire having a diameter of 3 mm, which is obtained by gathering fine copper wires having a diameter of 0.2 mm coated with a heat resistant insulating material into a bundle, for high-frequency use are provided so as to surround the fixing nip portion N.

4) The fixing film 2

FIG. 4 is a schematic diagram illustrating the configuration of layers of the fixing film 2. The fixing film 2 has a three-layer structure which includes a resistor layer (heating layer) 2*a* comprising a cylindrical nickel film 50 $\mu$m thick to be subjected to electromagnetic-induction heating, an elastic layer 2*b*, made of a silicone rubber, coated on the outer circumferential surface of the resistor layer 2*a*, and a releasing layer 2*c* made of a fluororesin coated on the elastic layer 2*b*.

As described above, by supplying the resistor layer 2*a* with the AC magnetic flux "a", the eddy currents "b" are generated in the resistor layer 2*a* to heat it. This heat heats the fixing nip portion N via the elastic layer 2*b* and the releasing layer 2*c*. The recording material, serving as a material to be heated, passing through the fixing nip portion N is thereby heated, so that the toner image t is heated and fixed.

The resistor layer 2*a* may be made of any other metal than nickel or a metal compound, provided that it is a good electric conductor having a resistivity of $10^{-5}$–$10^{-10}$ $\Omega\cdot$m. More preferably, a pure ferromagnetic metal having a high permeability, such as iron, nickel or the like, or a compound of these elements may be used.

If the thickness of the resistor layer 2*a* is too small, a sufficient magnetic path cannot be secured. As a result, the magnetic flux leaks to the outside of the layer, thereby reducing the heating energy of the resistor layer 2*a*. If the thickness of the resistor layer 2*a* is too large, the heat capacity increases, thereby tending to increase the time required for temperature rise.

Accordingly, there is an appropriate value for the thickness of the resistor layer 2*a* depending on the values of the specific heat, the density, the permeability, and the resistivity of the material used for the resistor layer 2*a*. In the present embodiment, a speed of temperature rise equal to or greater than 3° C./sec was obtained within the range of the thickness of 10–100 μm.

If the hardness of the elastic layer 2*b* is too large, the elastic layer 2*b* cannot sufficiently follow projections and recesses on the recording material or the toner layer, thereby producing unevenness in the gloss of the obtained image. Accordingly, the hardness of the elastic layer 2*b* is preferably equal to or less than 60° (JIS (Japanese Indusrial Standards)-A), more preferably, equal to or less than 45° (JIS-A).

The thermal conductivity λ of the elastic layer 2*b* is preferably $6\times10^{-4}$–$2\times10^{-3}$ cal/cm·sec·deg.

If the thermal conductivity λ is less than $6\times10^{-4}$ cal/cm·sec·deg, the thermal resistance increases, and temperature rise in the surface layer of the fixing film 2 becomes slow.

As well as a fluroresin, such as PFA, PTFE, FEP or the like, a heat resistant material having excellent releasability, such as a silicone resin, a silicone rubber, a flurorubber, a silicone rubber or the like, may be used for the releasing layer 2*c*.

The thickness of the releasing layer 2*c* is preferably 20–100 μm. If the thickness of the releasing layer 2*c* is less than 20 μm, unevenness in the the thickness of the coated film causes portions having inferior releasability and insufficient durability. On the other hand, if the thickness exceeds 100 μm, heat conduction becomes inferior. Particularly in a releasing layer made of a resin, the hardness becomes too large, and the effect of the elastic layer 2*b* disappears.

5) Experimental examples

Experimental examples for verifying the effects of the device of the embodiment will now be described.

(1) Rise time

The rise time was compared between the device of the embodiment and a conventional device of a heat roller type. The result of comparison is shown in Table 1. Values shown in Table 1 are time periods required to reach a temperature where the same fixing capability is obtained from the room temperature (25° C.) with a power of 1,000 W.

TABLE 1

| Heat roller type (Comparative Example 1) | Embodiment |
|---|---|
| 180 seconds | 10 seconds |

As can be understood from Table 1, remarkable improvement in the waiting time is obtained compared with the conventional heat-roller-type device.

(2) Durability

The mechanical durability of the fixing film 2 was compared among a case in which a PFA tube 50 μm thick is coated on the film guide 3 as the sliding member (slidably contacting layer) 8*a*, a case in which a film 9 μm thick is coated on the film guide 3 (Comparative Example 2), and a case in which the film guide 3 is not coated (Comparative Example 3), when the fixing film 2 and the pressing roller 6 are rotated (120 mm/sec) under a constant pressure ($1.2\times10^5$ Pa) without passing a sheet therebetween. The result of comparison is shown in Table 2. Values in Table 2 are operating times until a crack, flaw, chipping or the like was generated in the fixing film 2.

TABLE 2

| 50 μm (Embodiment) | 9 μm (Comparative Example 2) | 0 μm (Comparative Example 3) |
|---|---|---|
| >2,000 hours | 580 hours | 320 hours |

As can be understood from Table 2, high durability could be obtained by providing a sufficiently thick sliding member 8*a*.

Although in this experiment, a thin film was coated as the sliding member 8*a* in Comparative Example 2, the experiment was, of course, performed not for comparing the properties of films obtained by coating. That is, the same level of durability as the above-described tube, serving as the sliding member 8*a*, can be obtained provided that a sufficiently thick sliding member 8*a* can be obtained by a coating technique.

As described above, in the present embodiment, the presence of the sliding member prevents direct frictional contact between the inner surface of the rotating heating member having the shape of a cylindrical film and the film supporting member, so that the rotating heating member can be rotated in a state of a small driving torque and little wear due to friction. The wear of the film supporting member is also prevented.

In the present embodiment, by fixing the sliding member on the film supporting member, it is possible to improve the assembling capability of the device and to reduce the production cost of the device.

In addition, a sliding member made of a ceramic material, glass, a fluororesin, a polyimide resin or the like reduces the driving torque for rotating the rotating heating member without hindering electromagnetic induction heating, and prevents the wear and degradation of the resistor of the rotating heating member and the wear of the film supporting member.

Since the fixing device 100 of the present embodiment enables a fixing operation at a high temperature because of small internal heating, it is possible to sufficiently fuse a toner image even when fixing a full-color image having a large amount of toner, and to obtain an image forming apparatus which forms an image having high picture quality.

In a full-color image forming apparatus in which toner images of four colors are overlapped, it is important to perform stable rotation driving during image formation. Since the fixing device 100, serving as the heating device, of the present embodiment can reduce the driving torque as described above, high-quality precise image reproducibility without generating unevenness in the density can be obtained.

In the present embodiment, since the sliding member is fixed on the supporting member, it is possible to prevent an increase in the rise time of the device caused by an increase in the heat capacity of the film, and to improve thermal efficiency by causing the heat of the sliding member to contribute to heating of the image.

Figure 6:
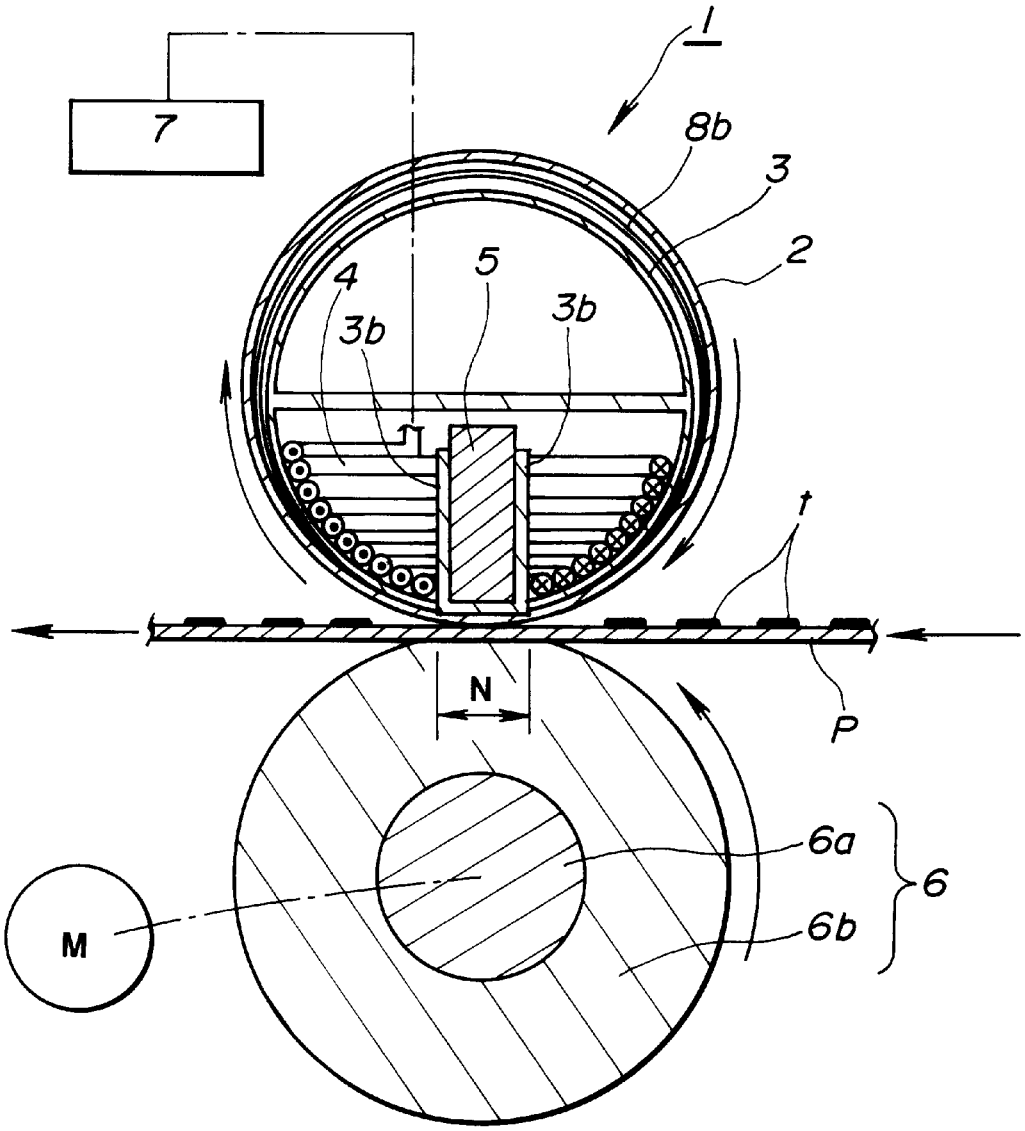
FIG. 6 is a schematic cross-sectional view illustrating the configuration of an image heating device according to another embodiment of the present invention.
Figure 7:
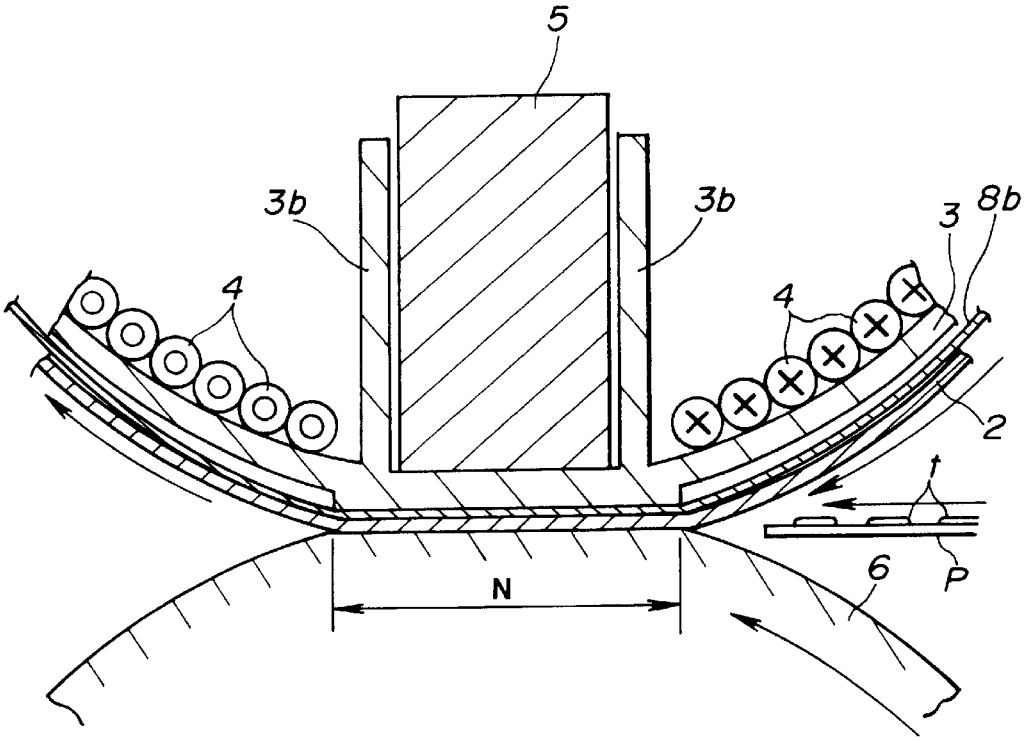
FIG. 7 is an enlarged view of a nip portion shown in FIG. 6.

FIG. 6 is a schematic cross-sectional view illustrating the configuration of an image heating device according to another embodiment of the present invention. FIG. 7 is a schematic cross-sectional view illustrating the configuration of a principal portion of the device shown in FIG. 6. In the present embodiment, a cylindrical sliding film 8*b* 30 μm thick made of a polyimide resin is loosely fitted in a cylindrical fixing film 2, and the fixing film 2 incorporating the sliding film 8*b* is loosely fitted to the outer circumference of a film guide 3.

The cylindrical sliding film 8*b* fitted in the fixing film 2 operates as a sliding member. That is, the fixing film 2 and the sliding film 8*b* are held between the lower surface of the film guide 3 and a pressing roller 6 to form a fixing nip portion N. When the pressing roller 6 is rotatably driven, the sliding film 8*b* present between the film guide 3 and the fixing film 2 operates as a sliding member to mitigate friction between the film guide 3 and the fixing film 2, and the fixing film 2 can smoothly rotate around the film guide 3 while producing slip with the sliding film 8*b* or carrying the sliding film 8*b*.

In the present embodiment, since the sliding film 8*b*, serving as the sliding member, is provided as a member separated from the fixing film 2 and the film guide 3, it is possible to reduce the production cost of the these components, and to provide an inexpensive fixing device or an image forming apparatus using the device.

Since the slidably contacting portion of the sliding film 8*b* with the fixing film 2 changes in accordance with the rotation, sufficient durability can be obtained even if a relatively thin film is used.

As a modification of the present embodiment, a pair of sliding films may be provided by fitting two cylindrical sliding films and filling a lubricant between them. With this configuration, it is possible to further reduce the driving torque and to improve durability. In addition, since the amount of wear of the films is very small, the degree of freedom when selecting materials is high, and therefore inexpensive materials can be selected.

As described above, by using a tube or a cylindrical film covering the supporting member as the sliding member, the resistor of the rotating heating member is protected at an arbitrary point on the film supporting member, the driving torque for the rotation of the rotating heating member is reduced, and the wear and degradation of the resistor of the rotating heating member and the wear of the film supporting member are prevented.

Figure 8A:
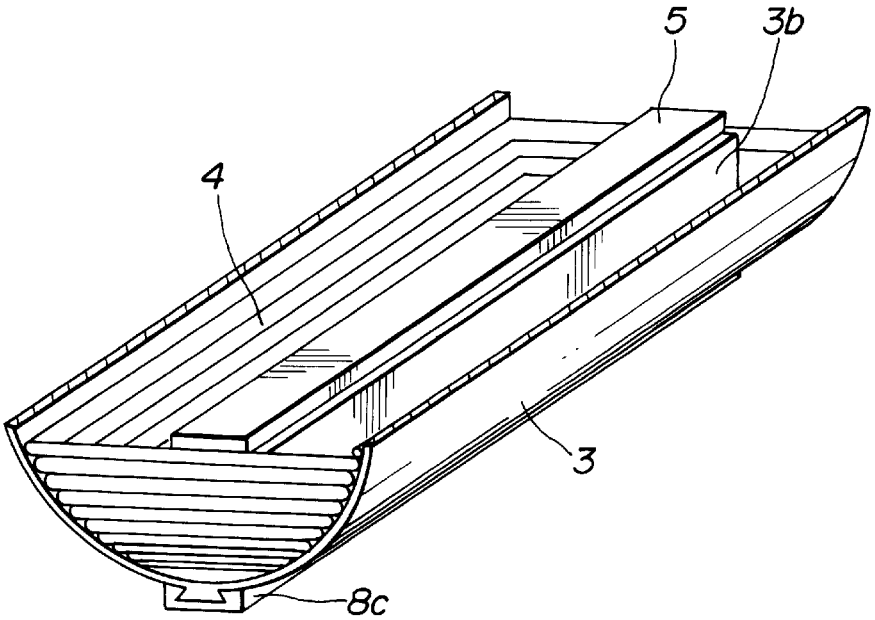
FIG. 8(*a*) is a cutaway perspective view of a film guide according to still another embodiment of the present invention.
Figure 8B:
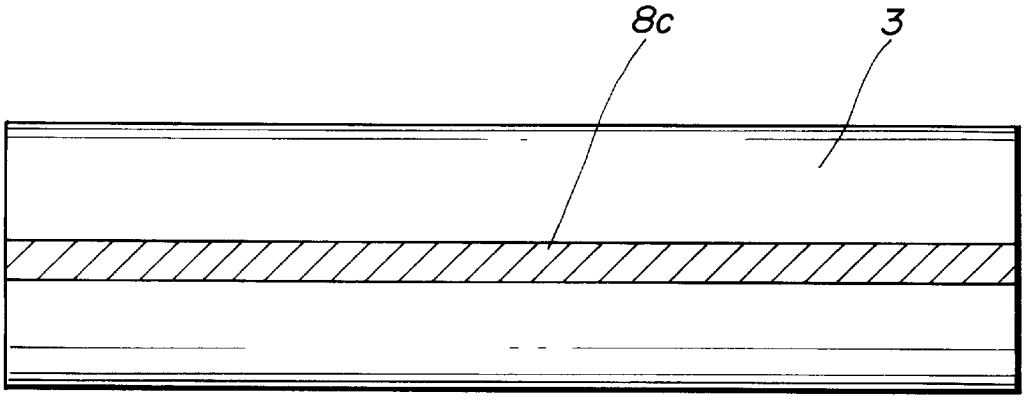

FIGS. 8(*a*) and 8(*b*) are diagrams illustrating the configuration of a device according to still another embodiment of the present invention: FIG. 8(*a*) is a cutaway perspective view of a film guide; and FIG. 8(*b*) is a bottom view of the film guide shown in FIG. 8(*a*).

In the present embodiment, a sliding member (sliding plate) 100 $\mu$m thick made of VESPEL (a trade name of the DuPont Corporation), which is a polyimide resin, is integrally formed at a portion corresponding to a fixing nip portion N at an outer base of a film guide 3.

The sliding member 8*c* may have a certain degree of thickness as in this configuration, and the same effect may be obtained by bonding a plate-like sliding member 8*c* made of glass, a ceramic material or the like instead of a polyimide resin on the portion corresponding to the fixing nip portion N at the outer base of the film guide 3.

This embodiment has the feature that, since strength can be maintained for a surface of the sliding member 8*c* which slidably contacts the inner surface of the fixing film, the device can be used under a high pressure.

In the present embodiment, durability of at least 2,000 hours during rotation without inserting a sheet was obtained at a pressure of $2.4\times10^5$ Pa.

The present embodiment also has the feature that the sliding member 8*c* may be used only at the position of the fixing nip portion N where pressure is applied, and therefore the device can be manufactured with a low cost.

Figure 9:
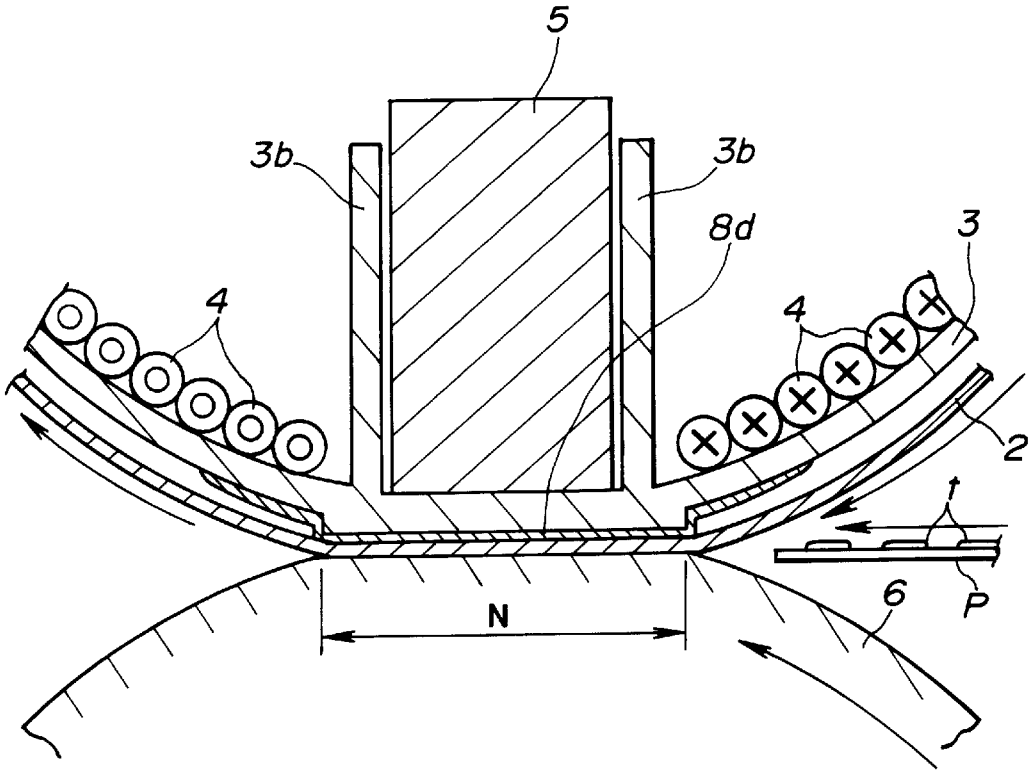
FIG. 9 is an enlarged view of a nip portion according to still another embodiment of the present invention.

FIG. 9 is a schematic cross-sectional view illustrating the configuration of a principal portion of a device according to still another embodiment of the present invention.

In this embodiment, a PTFE sliding layer about 25 m thick, serving as a sliding member 8*d*, is coated on the outer base of a film guide 3 in the vicinity of a fixing nip portion N.

In this embodiment, since the sliding layer, serving as the sliding member 8*d*, is formed after forming the film guide 3, it is possible to increase the production yield by inspecting accuracy in the forming of the film guide 3. In addition, since the coated layer is formed only on the outer base of the film guide 3 in the vicinity of the fixing nip portion N, the production cost of the device can be further reduced.

In some sliding members, the heat of the film is conducted to the sliding member, thereby increasing the rise time of the device caused by the temperature rise of the film. An exciting coil and a high-permeability core are disposed within a cylindrical film, and the critical temperature below which such an exciting member operates is not sufficiently high with respect to the temperature of the cylindrical film. Accordingly, by direct transmission of thermal energy produced within the cylindrical film to a coil supporting member, the efficiency of the exciting member, comprising the exciting coil and the high-permeability core, contacting the coil supporting member is reduced.

A description will now be provided of still another embodiment of the present invention which solves the above-described problems.

Figure 10:
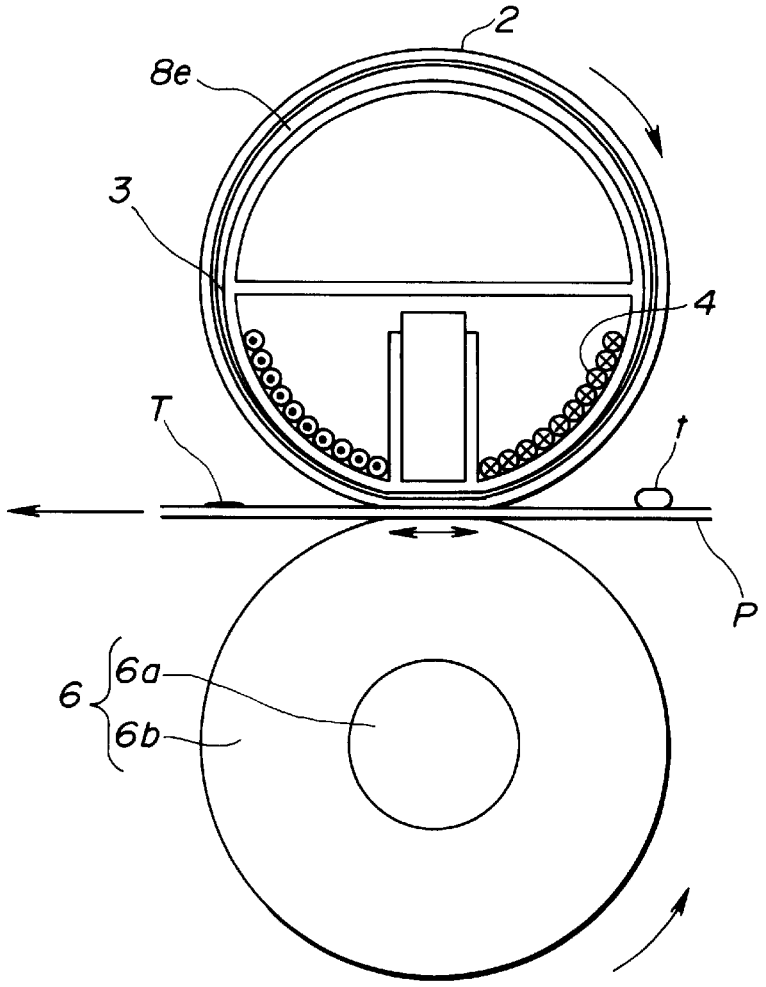
FIG. 10 is a schematic cross-sectional view illustrating the configuration of an image heating device according to still another embodiment of the present invention.

FIG. 10 is a schematic cross-sectional view illustrating the configuration of a device according to the embodiment. In FIG. 10, a fixing film 2 serves as a rotating heating member. An insulating film guide 3 serves as a film supporting member which does not hinder the passage of a magnetic flux. The fixing film 2 rotates in the direction of the arrow in a state in which the conveyance of the fixing film 2 is stabilized by the film guide 3. It is necessary to use a material capable of resisting a high load for the film guide 3, preferably PPS, PEEK, a phenol resin or the like.

An exciting coil 4 generates an AC magnetic flux, and is supported by the film guide 3 which also serves as a coil holder. An exciting circuit (not shown) is connected to the exciting coil 4. The exciting circuit can supply the exciting coil 4 with a 80-KHz AC current.

A pressing roller 6, serving as a rotating pressing member, comprises a core 6*a*, and a silicone-rubber layer 6*b* 2 mm thick coated thereon in order to provide elasticity, and forms a nip N with the fixing film 2. The pressing roller 6 also operates as a driving roller for rotatably driving the fixing film 2 in a direction to convey a recording material P.

Figure 11:
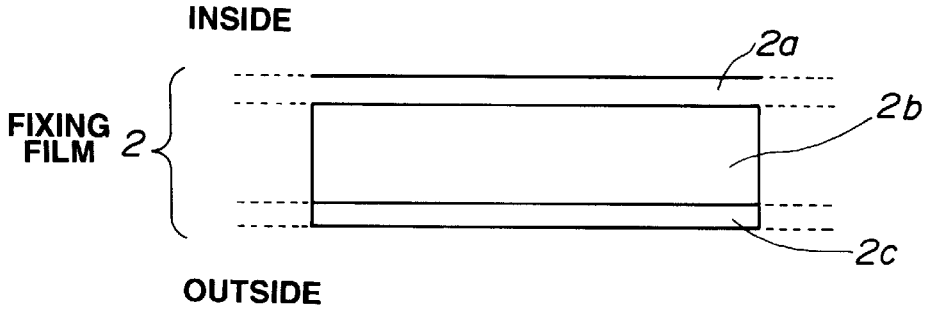
FIG. 11 is a schematic diagram illustrating the configuration of layers of a film shown in FIG. 10.

The fixing film 2 will now be described in detail with reference to FIG. 11. The fixing film 2 comprises a heating layer 2*a* 50 $\mu$m thick made of nickel serving as a resistor, an elastic layer 2*b* made of a silicone rubber coated on the surface of the heating layer 2*a*, and a fluororesin releasing layer 2*c* coated on the surface of the releasing layer 2*b*. Any metal other than nickel or a metal compound which is a good electric conductor having a resistivity of $10^{-5}$–$10^{-10}$ $\Omega\cdot$m may also be used as the resistor. More preferably, a pure ferroelectric metal having a high permeability, such as iron, cobalt or the like, or a compound of these metals may be used.

If the thickness of the heating layer 2*a* is too small, a sufficient magnetic path cannot be secured. As a result, the magnetic flux leaks to the outside of the layer, thereby reducing the heating energy of the heating layer 2*a*. If the thickness of the heating layer 2*a* is too large, the heat capacity increases, thereby tending to increase the time required for temperature rise.

Accordingly, there is an appropriate value for the thickness of the heating layer 2*a* depending on the values of the specific heat, the density, the permeability, the resistivity of the material used for the heating layer 2*a*. In the present embodiment, a speed of temperature rise equal to or greater than 3° C./sec could be obtained within the range of the thickness of 10–100 μm.

If the hardness of the elastic layer 2*b* is too large, the elastic layer 2*b* cannot sufficiently follow projections and recesses on the recording material or the toner layer, thereby producing unevenness in the gloss of the obtained image. Accordingly, the hardness of the elastic layer 2*b* is preferably equal to or less than 60° (JIS-A), more preferably, equal to or less than 45° (JIS-A).

The thermal conductivity λ of the elastic layer 2*b* is preferably 0.25–0.8 W/m·K.

If the thermal conductivity λ is less than 0.25 W/m·K, the thermal resistance increases, and temperature rise in the surface layer of the fixing film 2 becomes slow.

As well as a fluroresin, such as PFA, PTFE, FEP or the like, a heat resistant material having excellent releasability, such as a silicone resin, a silicone rubber, a flurorubber, a silicone rubber or the like, may be used for the releasing layer 2*c*.

The thickness of the releasing layer 2*c* is preferably 20–100 μm. If the thickness of the releasing layer is less than 20 μm, unevenness in the the thickness of the coated film causes portions having inferior releasability and insufficient durability. On the other hand, if the thickness exceeds 100 μm, heat conduction to the surface becomes inferior. Particularly in a releasing layer made of a resin, the hardness becomes too large, and the effect of the elastic layer 2*b* disappears.

The exciting coil 4 must generate an AC magnetic flux sufficient for heating. For that purpose, it is necessary to make the resistive component and the inductive component of the exciting coil 4 low and high, respectively. In the present embodiment, five turns of a core wire having a diameter of 3 mm, which is obtained by gathering fine copper wires having a diameter of 0.2 mm coated with a heat resistant insulating material into a bundle, for high-frequency use are provided so as to surround the nip N within the fixing film.

The exciting coil 4 generates an AC magnetic flux by an AC current supplied from an exciting circuit (not shown), and the AC magnetic flux generates eddy currents in the heating layer 2*a* of the fixing film 2. These eddy currents generate Joule heat by the specific resistance of the heating layer 2*a* and can thereby heat a recording material P conveyed to the nip N and a toner t on the recording material P via the elastic layer 2*b* and the releasing layer 2*c*.

In the present embodiment, by concentrating the exciting coil 4 in the vicinity of the nip N, it is possible to pass the generated magnetic field through a desired heating region, and to realize a high-efficiency image heating device.

Figure 12:
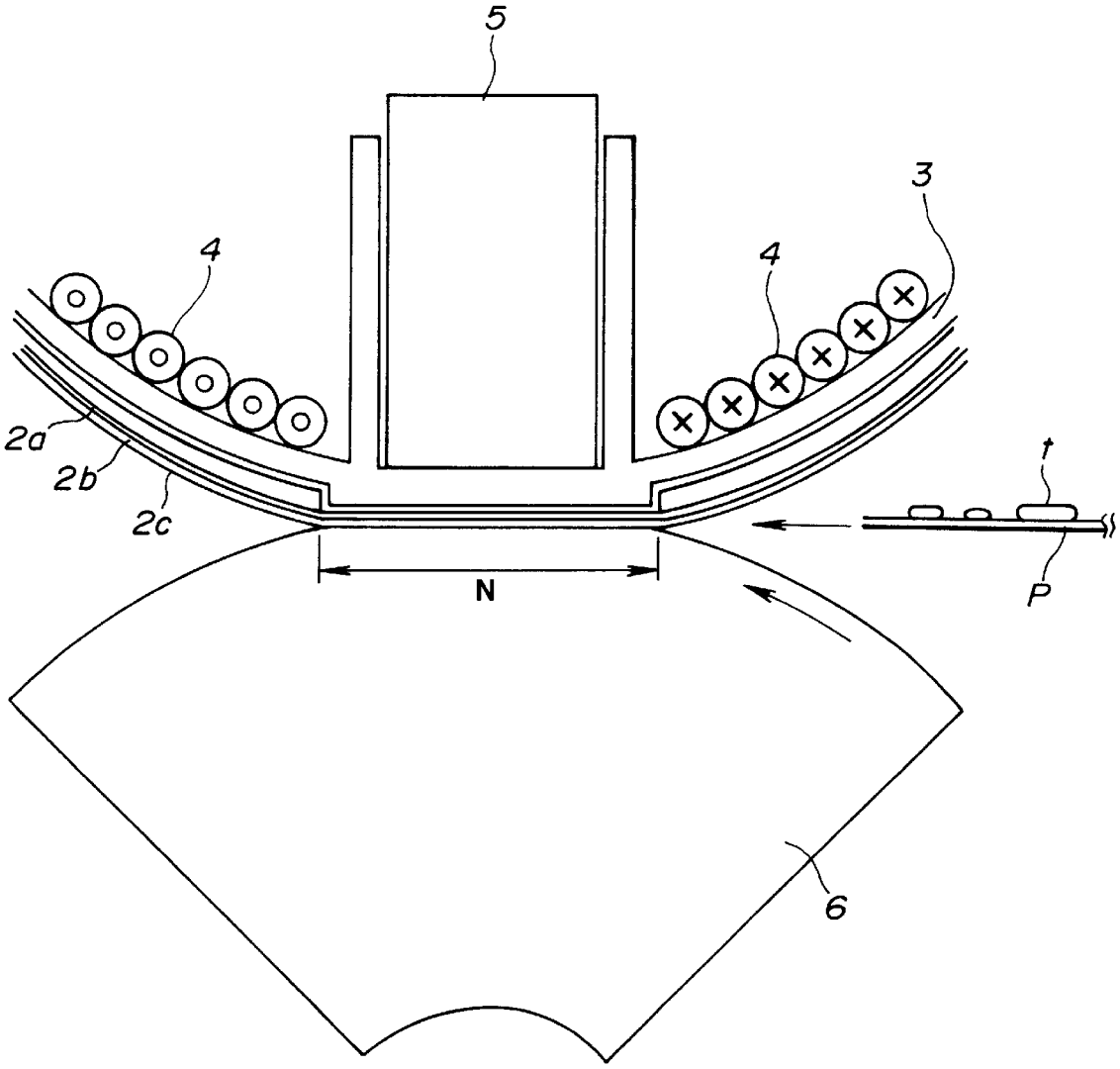
FIG. 12 is an enlarged view of a nip portion shown in FIG. 10.

FIG. 12 is an enlarged view illustrating a heat-insulating sliding member, serving as a sliding member 8*e*, which is a feature of this embodiment. A fluroresin, such as a PFA resin, a PTFE resin, an FEP resin or the like, a heat resistant resin, such as a polyimide resin, a polyamide resin, a polyamide-imide resin, a resin obtained by mixing these resins, or the like, which has high slidability, is preferably used for the heat-insulating sliding member. In the present embodiment, the sliding member 8*e* is formed by covering the coil holder 3 with a heat-contractive tube 80 μm thick made of a PFA resin. A material having a high thermal conductivity or a thin material has a low thermal resistance. Hence, when using such a material for the sliding member 8*e*, the generated heat is dissipated, so that the time required for temperature rise tends to increase. The thermal resistance per unit area θ ($m^2$·K/W) is obtained as $$\theta = t/\lambda$$

where λ (W/m·K) is the thermal conductivity of the substance, and t (m) is the length (thickness) of the substance in the direction of heat conduction. The values of the thermal conductivity of the above-described heat resistant resins are 0.15–0.3 W/m·K. By selecting the thickness of the sliding member 8*e* to be at least 50–100 μm, it is possible to make the thermal resistance of the sliding member 8*e* to be at least $3.3\times10^{-4}$ $m^2$·K/W. The basis of this value will be described later.

It is not against the gist of the present invention to supply an appropriate amount of lubricant, such as grease or the like, between the sliding member 8*e* and the fixing film 2. The sliding member in the present invention is a substance having a large area in contact with the inner surface of the fixing film 2 within the nip N. A lubricant does not satisfy this condition because it stays in a gap portion formed between the fixing film 2 and the coil holder 3 due to its high fluidity. Accordingly, it operates only as auxiliary means for reducing the driving torque and improving the heat insulating property which are objects of the present invention.

Experimental examples for verifying the effects of the device of the embodiment will now be described.

Figure 13:
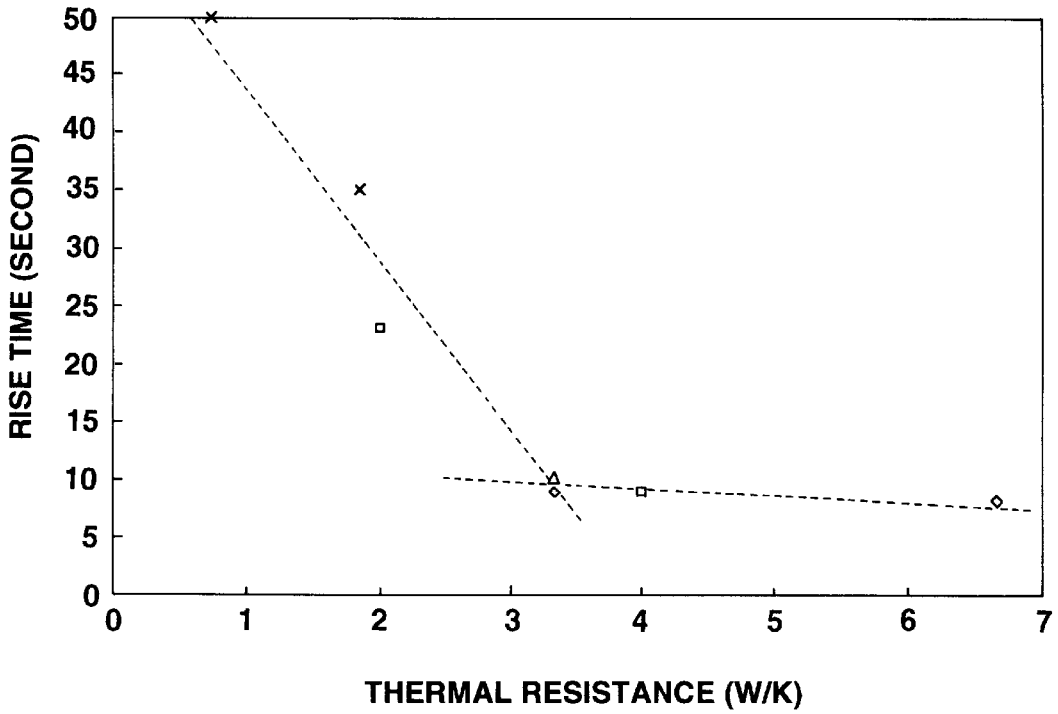
FIG. 13 is a graph illustrating the relationship between the thermal resistance of a sliding member and rise time.

The values of the rise time when changing the thermal resistance of the sliding member 8*e* in the configuration of the present embodiment were measured. The results are shown in FIG. 13. Values shown in FIG. 13 are time periods required for the surface of the fixing film 2 to reach a temperature where the same fixing capability is obtained (190° C.) from the room temperature (25° C.) when the same heat quantity per unit area ($4\times10^4$ J/$m^2$) is given in a state in which the fixing film 2 is rotated.

As can be understood from FIG. 13, as the thermal resistance of the sliding member 8*e* increases, the rise time decreases and becomes substantially constant when the thermal resistance is at least about $3.3\times10^{-4}$ $m^2$·K/W, i.e., the rise time becomes less than 10 seconds.

The state of temperature rise of the exciting coil was checked. The result indicates that the highest attainable temperature of the exciting coil decreases as the thermal resistance of the sliding member increases, so that the exciting coil can resist even continuous use.

The mechanical durability of the fixing film 2 was compared between a case in which a PFA tube 80 μm thick is coated on the film guide 3 as the sliding member 8*e*, and a case in which the film guide 3 is not coated (Comparative Example 4), when the fixing film 2 and the pressing roller 6 are rotated (120 mm/sec) under a constant pressure ($1.2\times10^5$ Pa) without passing a sheet therebetween. The result of comparison is shown in Table 3. Values in Table 3 are operating times until a crack, flaw, chipping or the like was generated in the fixing film 2.

TABLE 3

| 80 μm (Embodiment) | 0 μm (Comparative Example 4) |
|---|---|
| >2,000 hours | 320 hours |

As can be understood from Table 3, high durability could be obtained by providing the heat-insulating sliding member 8*e*.

As described above, according to the present embodiment, the heat-insulating sliding member can prevent direct friction between the inner surface of the rotating heating member and the film supporting member, reduce the driving torque, and prevent the temperature rise of the film supporting member by insulating heat conduction between the resistor and the film supporting member. Hence, it is possible to reducee the rise time of the device, and to prevent a decrease in thermal efficiency due to the temperature rise of the exciting coil and the like. Furthermore, by storing the generated heat in the vicinity of the nip, the thermal energy can be effectively transmitted to the surface of the cylindrical film.

Figure 14:
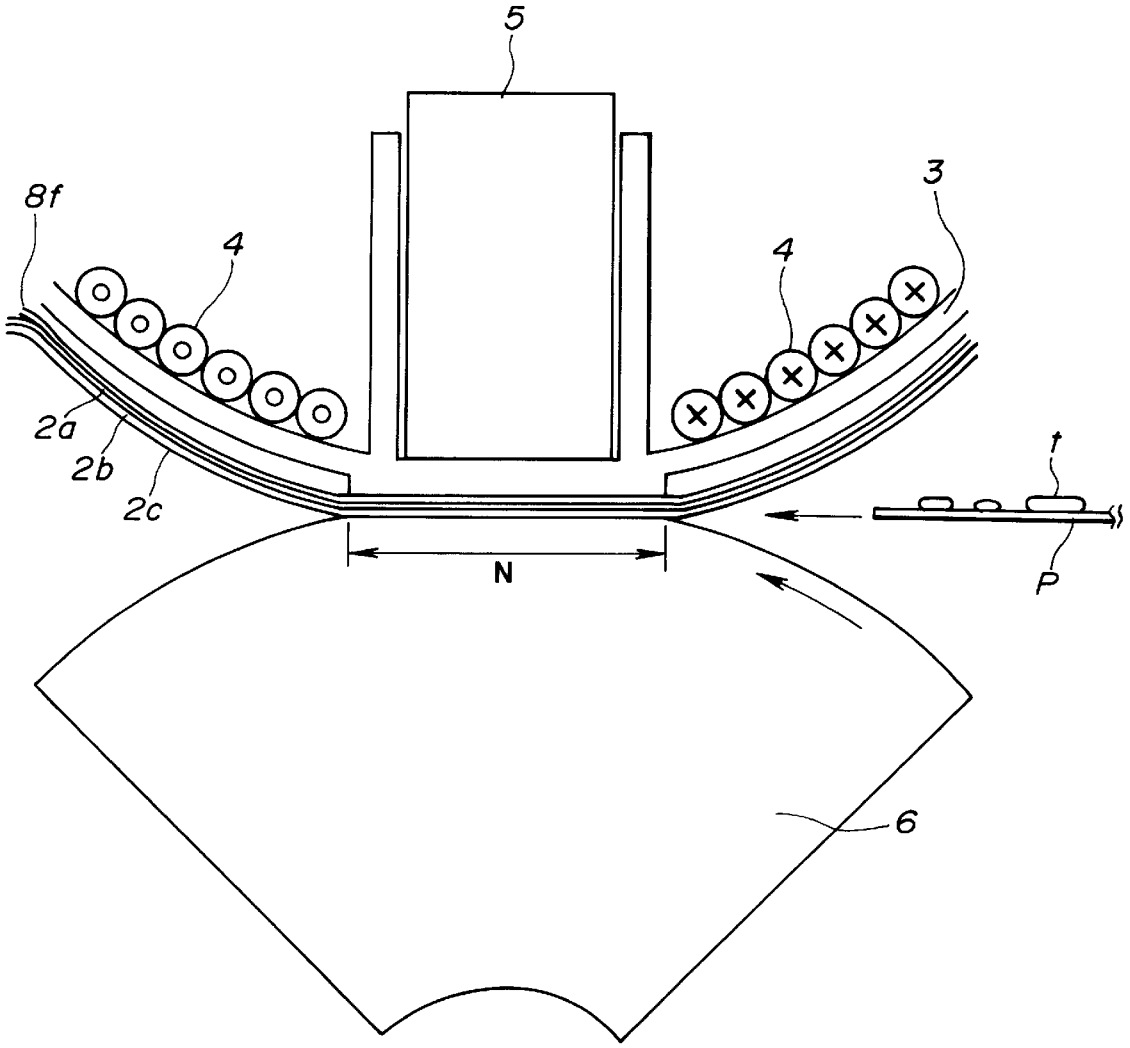
FIG. 14 is an enlarged view of a nip portion according to still another embodiment of the present invention.

FIG. 14 is a schematic enlarged cross-sectional view illustrating the configuration of a principal portion of a device according to still another embodiment of the present invention. In FIG. 14, the same reference numerals as in the foregoing embodiments represent the same components.

In the present embodiment, a sliding film 8*f* made of a polyimide resin (having a thermal conductivity of about 0.15 W/m·K) 50 μm thick, serving as a heat-insulating sliding member, is fitted to the inside of a fixing film 2. The thermal resistance of the sliding member 8*f* is at least $3.3\times10^{-4}$ $m^2\cdot K/W$. According to this configuration, the same effects as in the foregoing embodiments can also be obtained in the present embodiment.

The fixing film 2 is driven by being pressed by a pressing roller 6 at a nip portion N. In the present embodiment, the sliding film 8*f* present between a coil holder 3 and the fixing film 2 can smoothly rotate while producing slip with the fixing film 2 in a state of mitigating friction between the coil holder 3 and the fixing film 2.

In the present embodiment, since the sliding film 8*f*, serving as the heat-insulating sliding member, is provided as a member separated from the fixing film 2 and the coil holder 3, it is possible to reduce the production cost of these components, and to provide an inexpensive image heating device, or an image forming apparatus using the device.

Since a slidably contacting portion of the sliding film 8*f* changes in accordance with its rotation, local wear is reduced, and therefore sufficient durability can be obtained.

Furthermore, since the sliding film 8*f* can store some of the thermal energy generated by the fixing film 2 in the vicinity of the nip, the thermal energy can be more efficiently utilized than in a conventional approach in which a heat-insulating member is used in the base layer of a fixing film.

As a modification of the present embodiment, a pair of sliding films may be configured by fitting two sliding films to each other.

For example, by fitting a film made of a polyimide resin (having a thermal conductivity of about 0.15 W/m·K) 30 μm thick on a tube made of a PTFE resin (having a thermal conductivity of about 0.3 W/m·K) 50 μm thick, a higher heat insulating effect is obtained between the coil holder and the fixing film because a contact thermal resistance is present between the two components in addition to the sum of the values of the thermal resistance of the two components. As a result, the rise time can be reduced by effectively transmitting the thermal energy to the surface of the fixing film.

In this modification, it is possible to reduce the driving torque and to improve durability due to slidable movement between the films. In addition, the wear of the films is also small. Hence, a high degree of freedom is obtained when selecting the material and the thickness of each of the heat-insluating sliding members, and it is possible to choose inexpensive materials for the films.

Figure 15A:
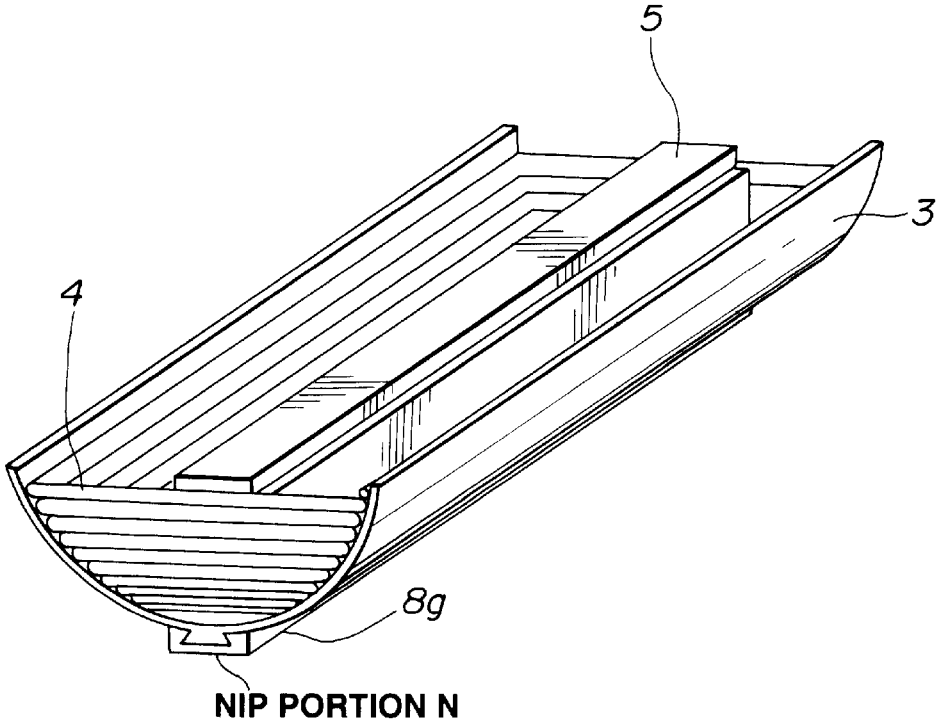
FIG. 15(*a*) is a cutaway perspective view of a film guide according to still another embodiment of the present invention.
Figure 15B:
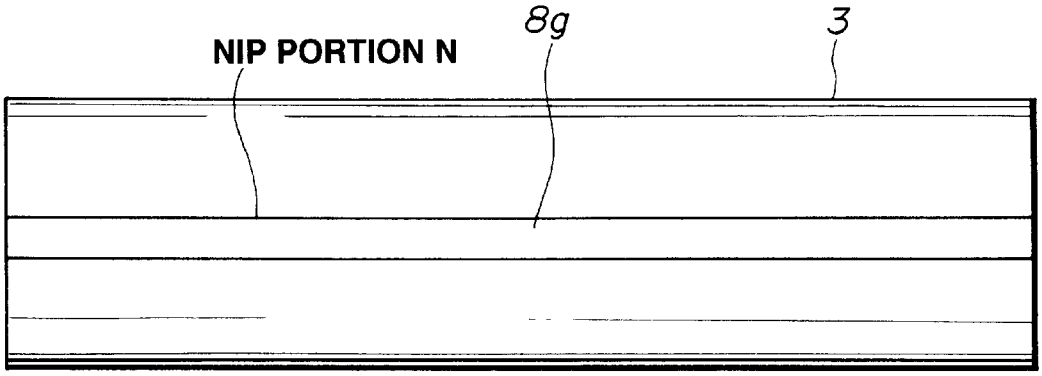

FIGS. 15(*a*) and 15(*b*) are a perspective view and a bottom view, respectively, illustrating the configuration of a principal portion of a device according to still another embodiment of the present invention. In FIGS. 15(*a*) and 15(*b*), the same reference numerals as in the foregoing embodiments represent the same components.

In the present embodiment, a heat insulating plate 8*g*, serving as a sliding member, 200 μm thick made of VESPEL (trade name) is integrally formed at a portion corresponding to a nip N at a coil holder 3.

The heat-insulating sliding member may have a certain degree of thickness as in this configuration, and the same effects may be obtained by bonding a plate-like member made of glass, a ceramic material or the like instead of a polyimide resin. The thermal resistance of the sliding member 8*g* is at least $3.3\times10^{-4}$ $m^2\cdot K/W$. According to this configuration, the same effects as in the foregoing embodiments can also be obtained in the present embodiment.

When using a plate-like member as the heat insulating member as in the present embodiment, the thermal resistance can be increased because the thickness can be larger than in the above-described embodiments using a tube, a film or the like. Accordingly, even when using a material having a relatively high thermal conductivity (about 2.7 W/m·K), such as alumina or the like, the same thermal resistance can be obtained by using a plate having a thickness of about 0.9 mm as the heat insulating plate of the present embodiment, and a rapid temperature rise can be obtained.

When using a tube or a film having a slidably moving surface at the nip portion as a heat insulating member, since the heat capacity of the heat insulating member is smaller than that of the fixing film, no problem arises. However, when using a plate-like member as a heat insulating member as in the present embodiment, the heat capacity and the thermal resistance increase and therefore cannot be neglected. That is, when the heat capacity of the heat insulating member is large, the heat generated in the fixing film is absorbed by the heat insulating member, thereby tending to reduce the temperature of the nip portion. This tendency is pronounced particularly when the temperature rises from a low temperature (the room temperature), thereby tending to increase the rise time. Accordingly, when using a plate-like heat insulating member as in the present embodiment, it is desirable to also take into consideration of the heat capacity, i.e., to select an appropriate thickness.

Figure 16:
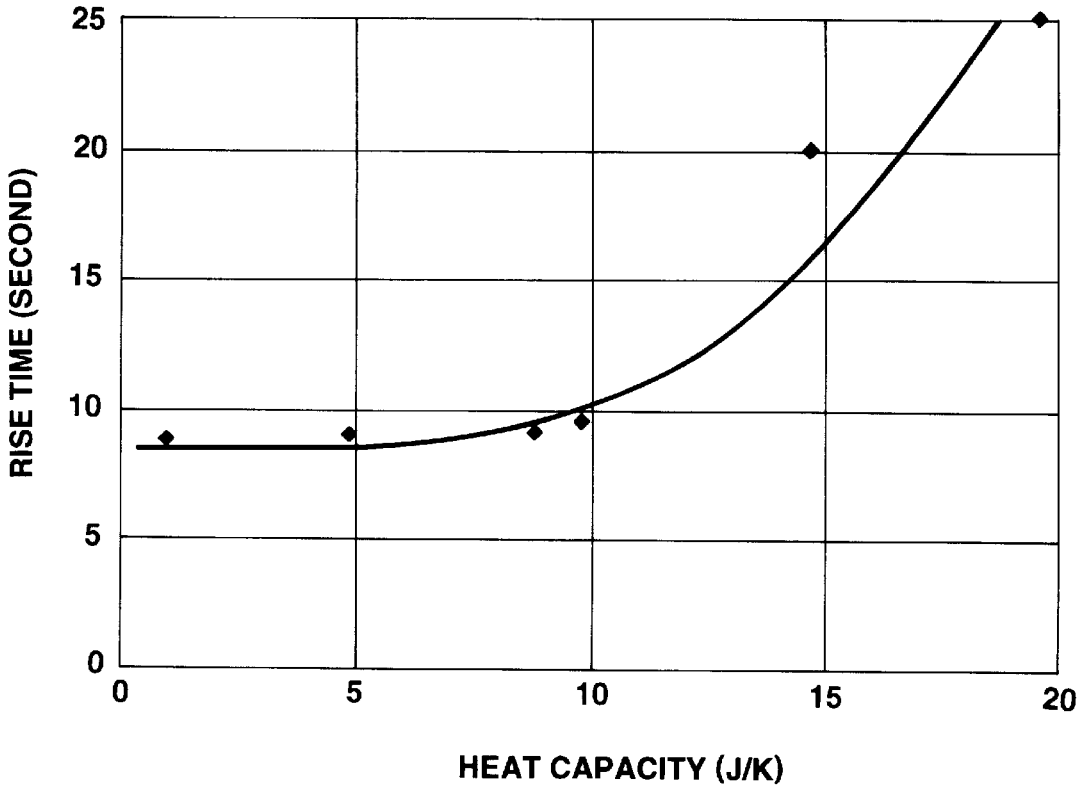
FIG. 16 is a graph illustrating the relationship between the thermal resistance of a sliding member and rise time.

FIG. 16 is a graph showing the result of investigation about the heat capacity of the heat insulating member. As the heat capacity increases, the speed of temperature rise from a low temperature decreases, and therefore the rise time increases as shown in FIG. 16. In the case of FIG. 16, the thickness of the member made of VESPEL (trade name) was changed. The same tendency was also obtained when using other heat insulating materials. Our conclusion is that the heat capacity of the heat insulating member is preferably equal to or less than 10 J/K. For example, the effects of the heat insulating member in the present embodiment are obtained by selecting a thickness equal to or less than about 2 mm for a heat insulating plate made of VESPEL (trade name), and a thickness equal to or less than about 1 mm for a heat insulating plate made of alumina, in the case of a nip area of 30 $cm^2$.

In the present embodiment, as the thickness of the plate made of VESPEL (trade name) is not more than 1,000 $\mu$m, the magnetic flux sufficiently reaches the resistor layer 2*a*.

A member comprising a single resistor layer 2*a*, serving as an electromagnetic-induction heating layer, may be used as the fixing film 2, serving as the rotating heating member. In general, a releasing layer is coated on the outer circumferential surface of the layer. The resistor layer 2*a* may be provided by mixing a metal filler in a resin.

Figure 17:
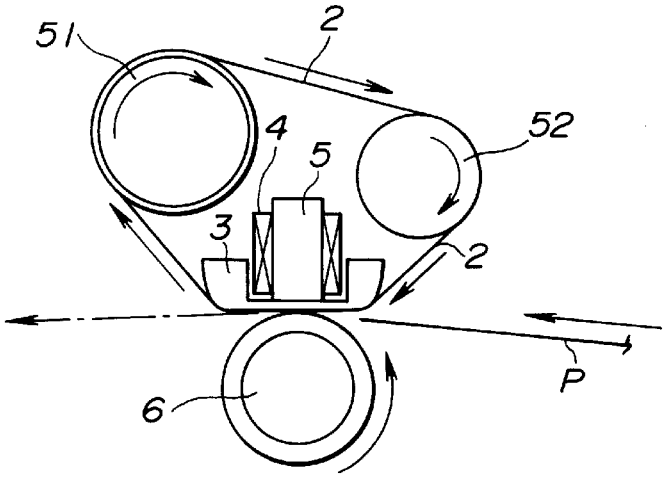
FIG. 17 is a schematic diagram illustrating the configuration of an image heating device according to still another embodiment of the present invention.

For example, as shown in FIG. 17, the fixing film 2, serving as the rotating heating member, may be stretched around a film guide 3, a film driving roller 51 and a film tension roller 52, and may be rotated by the rotation driving of the driving roller 51 in a state of slidably moving along the lower surface of the film guide 3. A pressing roller 6 is rotated in accordance with the rotation of the fixing film 2.

The pressing rotating member 6 may be in the form of a rotating belt, or of an electromagnetic-induction heating type.

The heating device of the present invention may, of course, be effectively utilized as a fixing device for a monochromatic or a single-path multicolor image forming apparatus. In such a case, the elastic layer 2*b* may be omitted in the fixing film 2. A description will now be provided of a monochromatic image forming apparatus.

Figure 18:
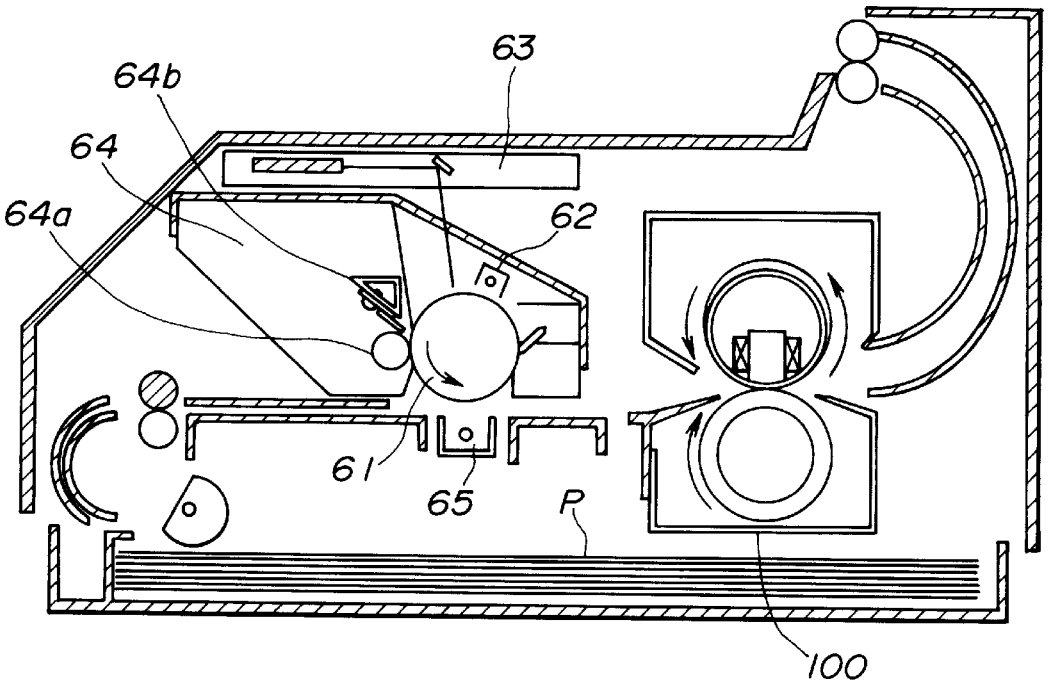
FIG. 18 is a schematic diagram illustrating the configuration of an image forming apparatus according to still another embodiment of the present invention.

FIG. 18 is a schematic cross-sectional view illustrating the configuration of an electrophotographic laser-beam printer, serving as a monochromatic image forming apparatus. In FIG. 18, an electrostatic latent image is formed on a photosensitive drum 61 by modulating the intensity of laser light from a scanner 63 by an image information signal transmitted from a host computer (not shown). The intensity and the illuminating spot size of the laser light are appropriately set in accordance with the resolution of the image forming apparatus and a desired image density. The electrostatic latent image on the photosensitive drum 61 is formed by maintaining portions illuminated by the laser light and other portions to a light-portion potential $V_L$ and a dark-portion potential VD provided by being charged by a primary charger 62, respectively. The photosensitive drum 61 rotates in the direction of the arrow, and the electrostatic latent image is sequentially developed by a developing unit 64. The height and triboelectrification of toner particles within the developing unit 64 are controlled by a developing sleeve 64*a* and a developing blade 64*b* to form a uniform toner layer on the developing sleeve 64*a*. The developing blade 64*b* is usually made of a metal or a resin. The developing blade 64*b* made of a resin contacts the developing sleeve 64*a* with an appropriate pressure. The toner layer formed on the developing sleeve 64*a* faces the photosensitive drum 61 as a result of rotation of the developing sleeve 64*a*, and portions having the potential $V_L$ are selectively developed to form a toner image by an electric field formed by the voltage Vdc applied to the developing sleeve 64*a* and the surface potential of the photosensitive drum 61. The toner image on the photosensitive drum 61 is sequentially transferred onto paper P fed from a sheet feeding device by a transfer device 65. A corona charger shown in FIG. 18, or a transfer roller which conveys paper while supplying it with transfer charges by supplying a conductive elastic rotating member with a current from a power supply may be used as the transfer device. The paper having the toner image transferred thereto is fed to a fixing device in accordance with the rotation of the photosensitive drum 61, and the toner image is converted into a permanently fixed image by applying heat and pressure.

The heating device of the present invention may be used not only as an image heating fixing device as in the above-described embodiment, but also as a device for heating a material to be heated, for example, a device for improving the surface property, such as gloss or the like, an image heating device for performing preliminary fixing, a device for heating/drying a material to be heated, or a heating laminating device.

The individual components shown in outline in the drawings are all well known in the image heating device arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image heating device comprising:

a film having a conductive portion, magnetic-flux generation means for generating a magnetic flux, an eddy current being generated in said film by the magnetic flux generated by said magnetic-flux generation means, said film being heated by the eddy current, wherein an image on a recording material is heated by heat of said film;

a supporting member for supporting said film; and a sliding member provided between said film and said supporting member, wherein said sliding member has a thickness of 10–1000 $\mu$m.

2. A device according to claim 1, wherein said sliding member is fixed on said supporting member.

3. A device according to claim 1, wherein said sliding member comprises an endless film loosely fitted around said supporting member.

4. A device according to claim 3, wherein said sliding member comprises a plurality of films.

5. A device according to claim 1, wherein said sliding member is comprised of a fluororesin.

6. A device according to claim 1, wherein said sliding member is comprised of a polyimide resin.

7. A device according to claim 1, wherein said sliding member is comprised of glass.

8. A device according to claim 1, wherein said sliding member is comprised of a ceramic material.

9. A device according to claim 1, wherein a thermal resistance of said sliding member is at least $3.3\times10^{-4}$ $m^2\cdot K/W$.

10. A device according to claim 1, wherein a heat capacity of said sliding member is no more than 10 J/K.

11. A device according to claim 1, wherein said film comprises an endless film loosely fitted around said supporting member.

12. A device according to claim 11, wherein said film comprises a conductive portion on a surface facing said supporting member.

13. A device according to claim 12, wherein said conductive portion comprises a metallic layer.

14. A device according to claim 13, wherein said film further comprises an elastic layer on said metallic layer, and a releasing layer on said elastic layer.

15. A device according to claim 1, wherein said magnetic-flux generation means comprises an exciting coil and a core.

16. A device according to claim 1, wherein said supporting member is fixed relative to said magnetic-flux generation means.

17. A device according to claim 1, wherein said supporting member is comprised of one of PPS, PEEK and a phenol-resin.

18. A device according to claim 1, wherein said supporting member also supports said magnetic-flux generation means.

19. A device according to claim 1, further comprising a backup member for forming a nip portion with said supporting member with said film disposed between said backup member and said supporting member.

20. A device according to claim 19, wherein said sliding member is provided at at least said nip portion.

21. A device according to claim 19, wherein said backup member comprises a pressing roller.

22. A device according to claim 21, wherein said pressing roller drives said film.

23. A device according to claim 1, wherein said film slides relative to said supporting member.

* * * * *

UNITED STATES PATENT AND TRADEMARK OFFICE

CERTIFICATE OF CORRECTION

PATENT NO. : 6,031,215

DATED : February 29, 2000

INVENTOR(S): HIDEO NANATAKI, ET AL.

It is certified that error appears in the above-identified patent and that said Letters Patent is hereby corrected as shown below:

COVER PAGE AT ITEM [56]
Foreign Patent Documents: "54-9027" should read --5-9027--.

COVER PAGE AT ITEM [56]
Other Publications: "Atsuuyoshi" should read --Atsuyoshi--.

COLUMN 15:
Line 17, "reducee" should read --reduce--.

Signed and Sealed this

Twenty-seventh Day of February, 2001

*Attest:*

Nicholas P. Godici

NICHOLAS P. GODICI

*Attesting Officer*

*Acting Director of the United States Patent and Trademark Office*